US009976368B2

(12) United States Patent
Hallundbæk et al.

(10) Patent No.: US 9,976,368 B2
(45) Date of Patent: May 22, 2018

(54) DOWNHOLE PUNCH COMPONENT

(75) Inventors: Jørgen Hallundbæk, Græsted (DK); Paul Hazel, Aberdeen (GB)

(73) Assignee: WELLTEC A/S, Allerød (DK)

( * ) Notice: Subject to any disclaimer, the term of this patent is extended or adjusted under 35 U.S.C. 154(b) by 1245 days.

(21) Appl. No.: 13/989,195

(22) PCT Filed: Nov. 25, 2011

(86) PCT No.: PCT/EP2011/071039

§ 371 (c)(1),
(2), (4) Date: May 23, 2013

(87) PCT Pub. No.: WO2012/069634

PCT Pub. Date: May 31, 2012

(65) Prior Publication Data

US 2013/0233555 A1 Sep. 12, 2013

(30) Foreign Application Priority Data

Nov. 26, 2010 (EP) ..... 10192706

(51) Int. Cl.
*E21B 23/14* (2006.01)
*E21B 29/08* (2006.01)
(Continued)

(52) U.S. Cl.
CPC ..... *E21B 23/14* (2013.01); *E21B 29/08* (2013.01); *E21B 34/06* (2013.01); *E21B 43/112* (2013.01)

(58) Field of Classification Search
CPC ..... E21B 23/14; E21B 34/06; E21B 43/112; E21B 29/08; E21B 33/138
See application file for complete search history.

(56) References Cited

U.S. PATENT DOCUMENTS 1,785,419 A 12/1930 Roscoe
2,526,695 A * 10/1950 Schlumberger ..... E21B 33/138 166/100
(Continued)

FOREIGN PATENT DOCUMENTS

CN 2656616 Y 11/2004
CN 101680281 A 3/2010
(Continued)

OTHER PUBLICATIONS

Patent Examination Report No. 3 dated Sep. 7, 2015 in Australian Application No. 2011333726 (5 pages).
(Continued)

*Primary Examiner* — Wei Wang
(74) *Attorney, Agent, or Firm* — Nixon & Vanderhye, P.C.

(57) ABSTRACT

The present invention relates to a downhole punch for insertion into a wall of a casing. The downhole punch comprises a body having a first end and a second end and a through-bore forming an inner face of the body and an outer face of the body, wherein the first end comprises at least one cutting edge at least forming a leading tip or a leading edge for punching an opening in the casing, and a component is arranged in the through-bore. The present invention also relates to a downhole valve for insertion into a wall of a casing. The downhole valve comprises a housing having a first end and a second end and an inner face and an outer face. Furthermore, the invention relates to a downhole tool for inserting a downhole valve into a wall of a casing, to a downhole system comprising the downhole tool as well as to a downhole method for insertion of a downhole unit into a casing downhole.

20 Claims, 5 Drawing Sheets

(51) Int. Cl.
*E21B 34/06* (2006.01)
*E21B 43/112* (2006.01)

(56) References Cited

U.S. PATENT DOCUMENTS

| | | | | |
|---|---|---|---|---|
| 4,009,753 | A | 3/1977 | McGill et al. | |
| 4,158,388 | A | 6/1979 | Owen et al. | |
| 4,765,173 | A | 8/1988 | Schellstede | |
| 4,932,129 | A | 6/1990 | Schellstede et al. | |
| 5,327,970 | A | 7/1994 | McQueen et al. | |
| 5,458,200 | A | 10/1995 | Lagerlef et al. | |
| 6,155,150 | A | 12/2000 | Cooper et al. | |
| 6,173,787 | B1 | 1/2001 | Wittrisch | |
| 7,905,286 | B2 * | 3/2011 | Moody | E21B 33/138 166/298 |
| 2001/0000379 | A1 | 4/2001 | Cooper et al. | |
| 2008/0029165 | A1 | 2/2008 | Beck | |
| 2008/0135235 | A1 | 6/2008 | McCalvin | |
| 2008/0277119 | A1 | 11/2008 | Hill, Jr. et al. | |
| 2010/0051847 | A1 | 3/2010 | Mailand et al. | |
| 2010/0096190 | A1 | 4/2010 | Younger et al. | |

FOREIGN PATENT DOCUMENTS

| | | | |
|---|---|---|---|
| EP | 0 962 624 | | 12/1999 |
| GB | 2 330 162 | | 4/1999 |
| GB | 2 340 158 | | 2/2000 |
| RU | 2 057 894 | C1 | 4/1996 |
| RU | 60 132 | U1 | 1/2007 |
| RU | 2 354 801 | C2 | 5/2009 |
| RU | 2 403 380 | C1 | 11/2010 |
| WO | WO 2005/019596 | A1 | 3/2005 |
| WO | WO 2007/073401 | | 6/2007 |
| WO | WO 2009/093069 | A2 | 7/2009 |

OTHER PUBLICATIONS

International Search Report for PCT/EP2011/071039 dated Apr. 24, 2012.

Written Opinion of the International Searching Authority dated Apr. 24, 2012.

Notification of Transmittal of the International Preliminary Report on Patentability for corresponding PCT/EP2011/071039, dated Jun. 4, 2013 (15 pages).

Extended European Search Report dated Apr. 15, 2011 in European Appln. No. EP 10192706.9 (7 pages).

Chinese Office Action dated Jun. 3, 2015 in Chinese Application No. 201180056675.2, with English Translation (19 pages).

* cited by examiner

DOWNHOLE PUNCH COMPONENT

This application is the U.S. national phase of International Application No. PCT/EP2011/071039 filed 25 Nov. 2011 which designated the U.S. and claims priority to EP 10192706.9 filed 26 Nov. 2010, the entire contents of each of which are hereby incorporated by reference.

FIELD OF THE INVENTION

The present invention relates to a downhole punch or valve for insertion into a wall of a casing. Furthermore, the invention relates to a downhole tool for inserting a downhole punch or valve into a wall of a casing, to a downhole system comprising the downhole tool and a driving unit as well as to a downhole method for insertion of a downhole punch or valve into a casing downhole.

BACKGROUND ART

During production, it may be expedient to change the openings through which oil fluid can enter the casing, thus sealing the existing openings, and create new openings. However, such operations may be very difficult to perform in muddy fluid where visibility is low and the casing is narrow.

One type of opening may be a valve to be inserted at another position in the casing when the oil production zone is sealed off. Thus, there is a need for a simple solution for inserting new valves in the wall of a casing.

SUMMARY OF THE INVENTION

It is an object of the present invention to wholly or partly overcome the above disadvantages and drawbacks of the prior art. More specifically, it is an object to provide an improved simple solution for inserting a downhole valve, and thus for a valve which can easily be inserted into the wall of a casing.

The above objects, together with numerous other objects, advantages, and features, which will become evident from the below description, are accomplished by a solution in accordance with the present invention by a downhole punch for insertion into a wall of a casing, comprising:

a body having a first end and a second end and a through-bore forming an inner face of the body and an outer face of the body, wherein the first end comprises at least one cutting edge at least forming a leading tip or a leading edge for punching an opening in the casing, and a component is arranged in the through-bore.

In an embodiment, the component may be a valve, a sensor, an emitter, a receiver, a probe or a communication device arranged in the through-bore.

By having a valve or a sensor in the through-bore, the punching tool can be punched into the casing without clearance so that the punching tool is fastened to the casing, and thus the valve or sensor is fastened in the casing.

Further, the body in cross-section may have a periphery and the cutting edge may be arranged in the periphery.

Moreover, the valve may be an inflow control valve, a gas lift valve, a throttle or a pressure control valve.

Also, the sensor may be a temperature sensor, pressure sensor, resistivity sensor, electromagnetic sensor, acoustic sensor, capacitance sensor, or a density sensor.

Additionally, the component may be a seismic transceiver or a detonation charge.

The cutting edge may be arranged as an extension of the outer face.

Furthermore, the cutting edge may extend from the inner face to the outer face.

Said cutting edge may have a meander shape.

Also, the body in cross-section may have a circumference and the cutting edge may extend partly or fully around the circumference.

The present invention further relates to a downhole valve for insertion into a wall of a casing, comprising:

a housing having a first end and a second end as well as an inner face and an outer face, wherein the first end of the housing comprises at least one cutting edge at least forming a leading tip or a leading edge for punching an opening in the casing.

In an embodiment, the housing in cross-section may have a periphery and the cutting edge may be arranged in the periphery.

In one embodiment, the housing may have an inlet at the first end and an outlet at the second end.

Furthermore, the housing may comprise a valve means for restricting the flow from the inlet to the outlet.

The valve may have an axial extension and an axial direction from the inlet to the outlet.

Moreover, the valve means may comprise a diaphragm.

Additionally, the valve means may comprise a spring acting on a piston.

The aforementioned cutting edge may be arranged as an extension of the outer face.

Also, the cutting edge may extend from the inner face to the outer face.

In addition, the cutting edge may be arranged at an angle in relation to a radial extension from the inner face to the outer face.

Further, the cutting edge may have a meander shape.

Moreover, the housing in cross-section may have a circumference, and the cutting edge may extend partly or fully around the circumference.

The wall of the housing may be made of a metal, such as cemented carbide, tungsten-carbide cobalt, hard metal or widia.

Further, the valve may be an inflow control valve, a gas lift valve, a throttle or a pressure control valve.

Also, the outer face of the housing may be provided with a thread.

The present invention furthermore relates to a downhole tool for inserting a downhole valve or the downhole punching device as described above into a wall of a casing, comprising:

at least one downhole valve, and a moving means for moving the valve to penetrate the wall of the casing.

In one embodiment, the casing may have an axial extension, and the tool may move the valve so that the axial extension of the valve is transverse to the axial extension of the casing.

In addition, the downhole tool may further comprise a holder for holding the valve.

The holder may comprise a contact surface.

Moreover, the moving means may comprise a piston punching the valve through the casing.

Furthermore, the moving means may screw the valve through the casing.

In addition, the moving means may rotate the valve so that the valve drills itself through the casing.

The downhole tool may further comprise a magazine comprising several valves to be inserted into the wall of the casing.

Additionally, the downhole tool may further comprise a stop means for controlling the moving means so that the valve penetrates the wall of the casing and the second end face is aligned with an inner face of the wall of the casing.

The present invention furthermore relates to a downhole system comprising the downhole tool and a driving unit, such as a downhole tractor, for moving the tool forward in the casing.

Finally, the present invention relates to a downhole method for insertion of a downhole unit, such as a punch or a downhole valve as described above, into a casing downhole, comprising the steps of:

arranging the unit outside a predetermined position in the casing, punching a hole in the casing by means of the cutting edge of the unit, leaving the unit in the casing.

This method may further comprise the steps of arranging a second unit at the predetermined position, and pushing the second unit into the hole and replacing the former unit.

Also, the second unit may have a larger outer diameter than the former unit.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1:
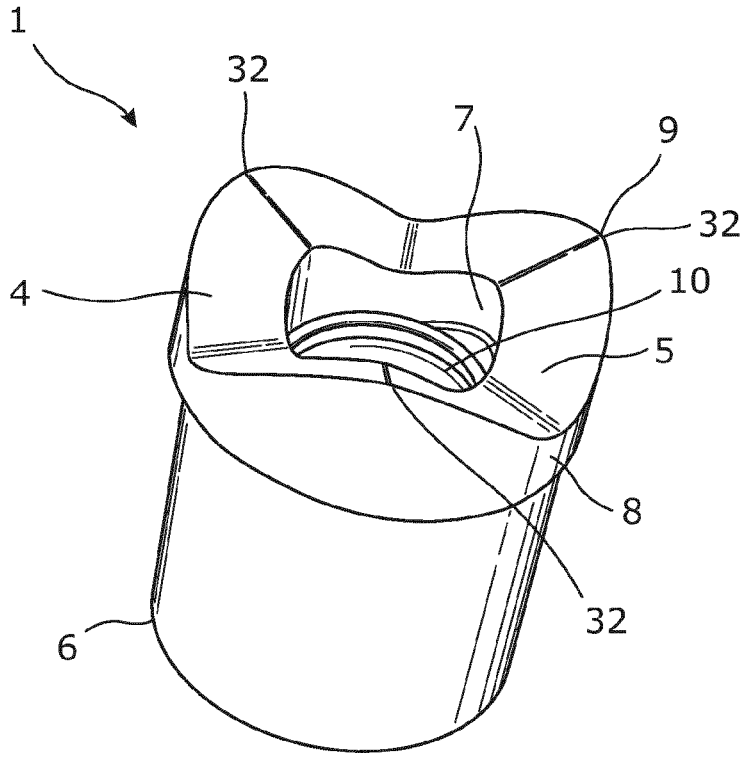
FIG. 1 shows a downhole valve.

FIG. 1 shows a downhole valve 1 for insertion into a wall 2 of a casing 3 in a well in order to let formation fluid into the casing. The valve 1 comprises a housing 4 having a first end 5 and a second end 6. The housing 4 has a cutting edge 9 arranged at the first end 5 of the housing. The housing 4 comprises an inner face 7 and an outer face 8, and in FIG. 1, the cutting edge 9 is arranged as an extension of the outer face 8 so that the outer face 8 terminates in the cutting edge at the first end. The cutting edge 9 has a meander shape when seen from the side. The cutting edge 9 curves up and down forming at least one leading tip 32 of FIG. 1 being three tips or leading edge 33 of FIG. 2 enabling the valve 1 to cut itself into the wall 2 of the casing 3 when being punched into the casing wall.

The housing 4 has an inlet at the first end 5 of the housing 4 and an outlet at the second end 6 of the housing 4. Inside the housing 4, the valve 1 comprises a valve means 10 providing a valve function and restricting free flow from the inlet to the outlet in an axial direction of the valve 1.

The valve means 10 comprises a diaphragm, a throttle, a spring acting on a piston or similar means providing controlled flow restriction in the axial direction of the valve 1. Thus, the valve 1 may be any kind of valve, such as a flow control valve, a gas lift valve, a throttle or a pressure controlled valve.

Figure 2:
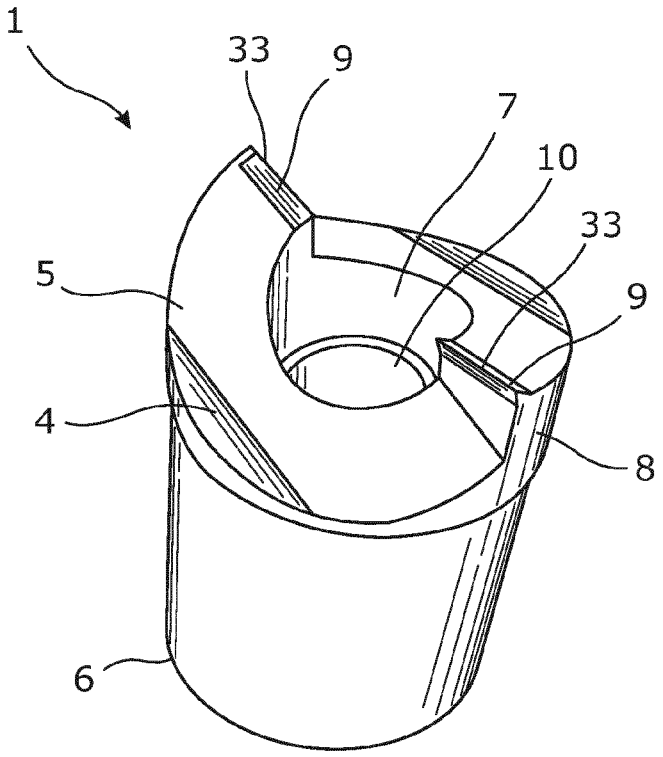
FIG. 2 shows another embodiment of the valve.

As shown in FIG. 2, the valve 1 has two cutting edges 9 which extend from the inner face 7 to the outer face 8, and between the cutting edges, a first end face of the first end 5 of the housing 4 inclines, causing the cutting edges 9 to form a tip of the housing 4. When the valve is punched into the casing wall 2 by pushing the valve from a second 38 end face of the second end 6 of the housing 4, the cutting edges 9 cut through the wall. Each cutting edge 9 extends along the radius from the inner face 7 to the outer face 8. In another embodiment, the cutting edge 9 is arranged at an angle in relation to a radial extension from the inner face 7 to the outer face 8.

When seen in cross-section, as in FIG. 1, the housing 4 has a circumference, and the cutting edge 9 extends fully around the circumference. In FIG. 2, the cutting edge 9 forms only part of the circumference.

In order to be able to cut itself into the casing 3 when used as a punch, the housing wall is made of a metal, such as cemented carbide, tungsten-carbide cobalt, hard metal or widia.

Figure 7:
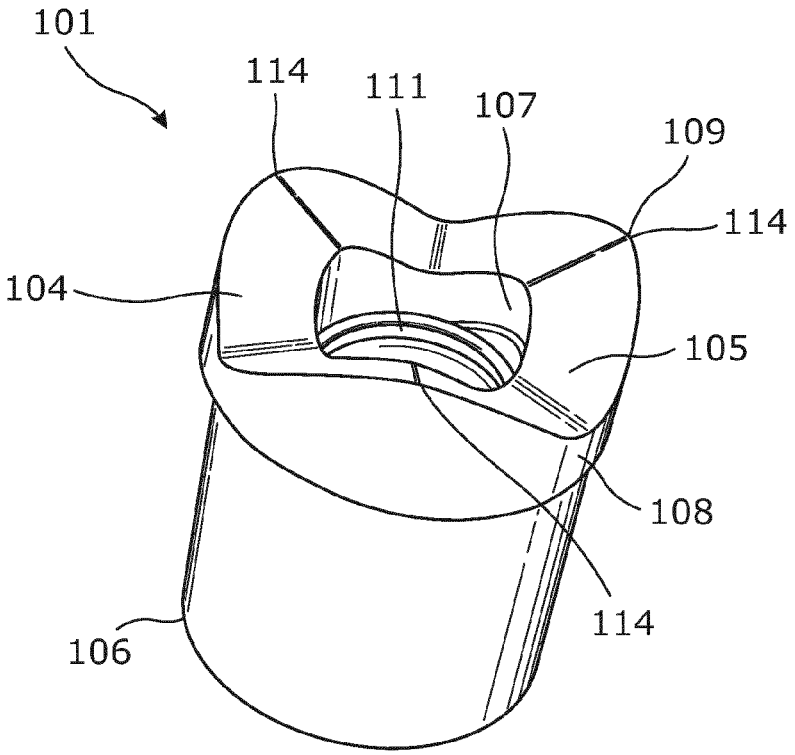
FIG. 7 shows a downhole punch.
Figure 8:
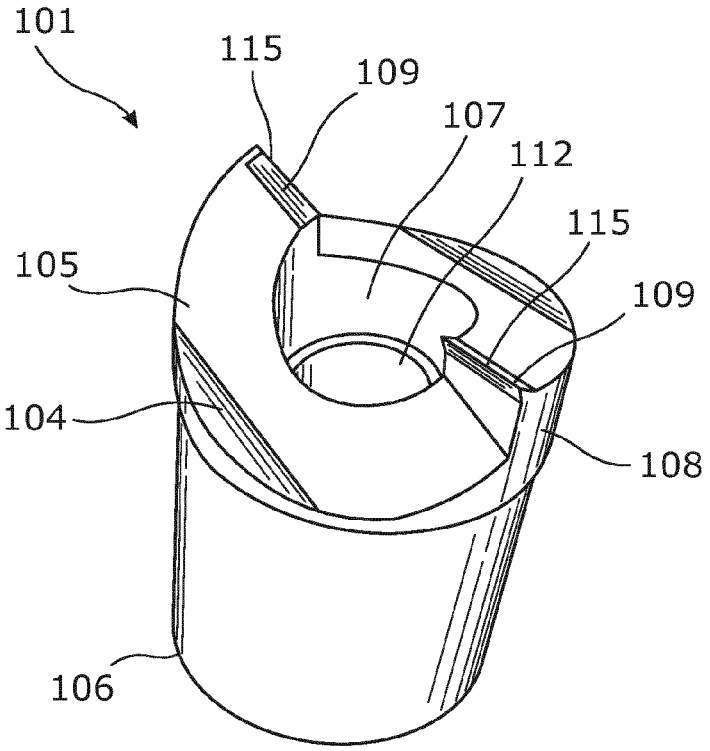
FIG. 8 shows another embodiment of the downhole punch.

FIG. 7 shows a downhole punch 101 for insertion into a wall 2 of a casing 3 in a well in order to let formation fluid into the casing or to sense formation and/or fluid properties. The downhole punch 101 comprises a body 104 having a through-bore in which a valve 111 or a sensor 112 is arranged. The body has a first end 105 and a second end 106, and in the first end the body 104 has a cutting edge 109. The body 104 comprises an inner face 107 and an outer face 108, and in FIG. 7, the cutting edge 109 is arranged as an extension of the outer face 108 so that the outer face 108 terminates in the cutting edge at the first end. Thus, the first end has at least one leading tip 114 being three leading tips 114 in FIG. 7 or a leading edge 115 being two leading edges as shown in FIG. 8 leading in the punching process and thus being the first part of the punch to contact the casing when the punch is being punched into the casing. The leading tips form part of the cutting edge 109. The cutting edge 109 has a meander shape when seen from the side. The cutting edge 109 curves up and down and forms the three tips enabling the punch 101 to cut itself into the wall 2 of the casing 3 when being punched into the casing wall.

The body 104 has an inlet at the first end 105 of the body 104 and an outlet at the second end 106 of the body 104. Inside the body 4, the downhole punch 101 comprises a valve 111 restricting free flow from the inlet to the outlet in an axial direction of the downhole punch 101. In another embodiment, the body of FIG. 7 comprises a sensor.

The valve comprises a diaphragm, a throttle, a spring acting on a piston or similar means providing controlled flow restriction in the axial direction of the valve 1. Thus, the valve 1 may be any kind of valve, such as a flow control valve, a gas lift valve, a throttle or a pressure controlled valve.

As shown in FIG. 8, the downhole punch 101 has two cutting edges 9 which extend from the inner face 107 to the outer face 108, and between the cutting edges, a first end face of the first end 105 of the body 104 inclines, causing the cutting edges 109 to form a tip of the body 104, the tip being a leading tip or front tip and being the first part of the punch to contact the casing. When the downhole punch 101 is punched into the casing wall 2 by pushing the downhole punch 101 from a second 38 end face of the second end 106 of the body 104, the cutting edges 109 cut through the wall. Each cutting edge 109 extends along the radius from the inner face 107 to the outer face 108.

In another embodiment, the cutting edge 109 is arranged at an angle in relation to a radial extension from the inner face 107 to the outer face 108.

When seen in cross-section, the body 104 has a circumference. The cutting edge 109 of FIG. 7 extends fully around the circumference. In FIG. 8, the cutting edge 109 forms only part of part of the circumference.

The cutting edge 9 may be part of a bit welded or embedded into the first end 5 of the housing 4 or the body 104.

In another embodiment, the outer face 8 of the housing 4 or the body 104 is provided with a thread, and the valve 1 or the punch 101 is screwed into the wall 2 of the casing 3. Hereby, the valve 1 or the punch 101 is mechanically secured into the wall of the casing 3 and can withstand direct pressure acting on the first end 5.

Figure 3:
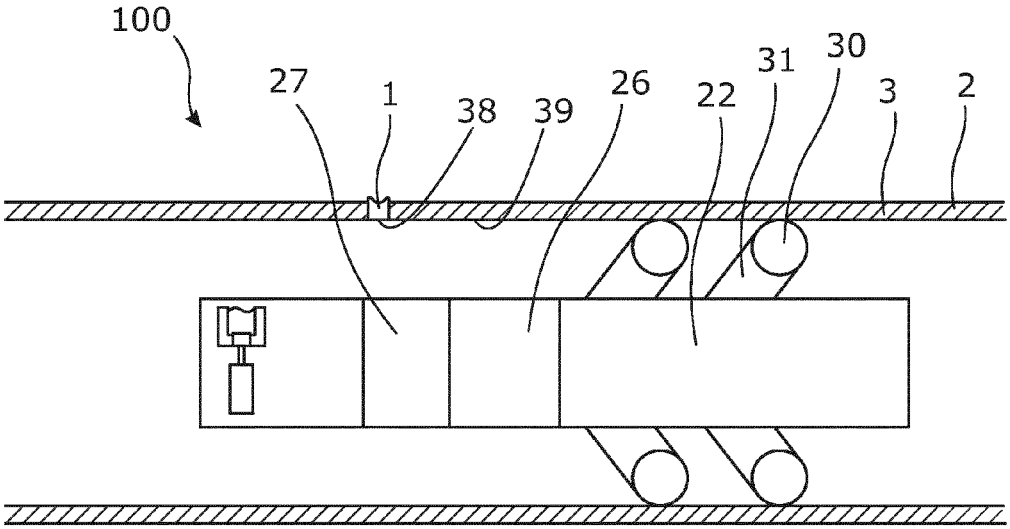
FIG. 3 shows a downhole tool in a casing.
Figure 9:
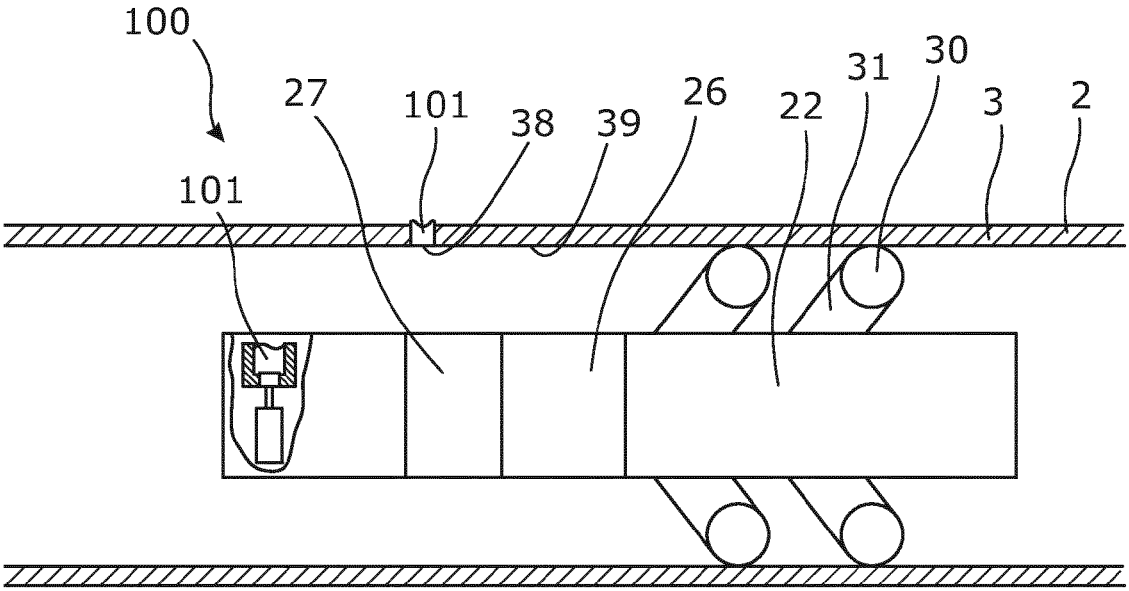
FIG. 9 shows the downhole tool in a casing.

The valve 1 or the punch 101 is inserted in the casing 3 by means of a downhole tool 100 comprising a moving means 12 for moving the valve 1 or the punch 101 so that it penetrates the wall 2 of the casing 3, as shown in FIGS. 3 and 9, respectively. The moving means 12 provides a movement transverse to the longitudinal extension of the tool 100 and the axial extension of the casing 3.

Figure 4:
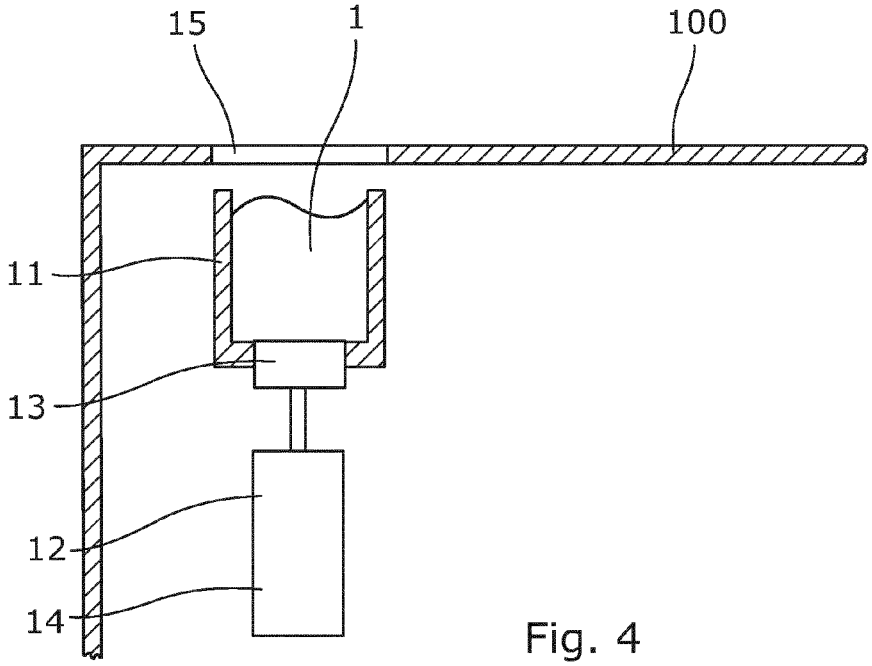
FIG. 4 shows a partly cross-sectional view of part of another embodiment of the downhole tool.

As shown in FIG. 4, the moving means 12 comprises a holder 11 for holding the valve 1 or the punch 101. The moving means 12 furthermore comprises a piston 13 which is activated by a cylinder 14 and which moves the holder 11 holding the valve 1 or the punch 101 through an opening 15 in the tool 100. The opening 15 is sealed by a blocking plate made of e.g. glass breaking when the moving means 12 punches the valve 1 or the punch 101 into the casing wall 2.

When the moving means 12 moves the valve 1 or the punch 101 towards the wall 2 of the casing 3, a contact surface of the holder 11 abuts the inner face 39 of the casing 3, providing a backstop and a measure of how far the moving means 12 has to punch and/or rotate into the casing wall in order for the second end 6 of the valve 1 to be aligned with the inner face 39 of the casing 3. This serves to ensure that the valve 1 or the punch 101 does not extend into the casing 3, thereby decreasing the inner diameter of the casing 3.

In order to move the valve 1 or the punch 101 to penetrate the casing wall 2, the moving means 12 comprises a piston 13 punching or pushing the valve 1 or the punch 101 through the casing 3.

Figure 5:
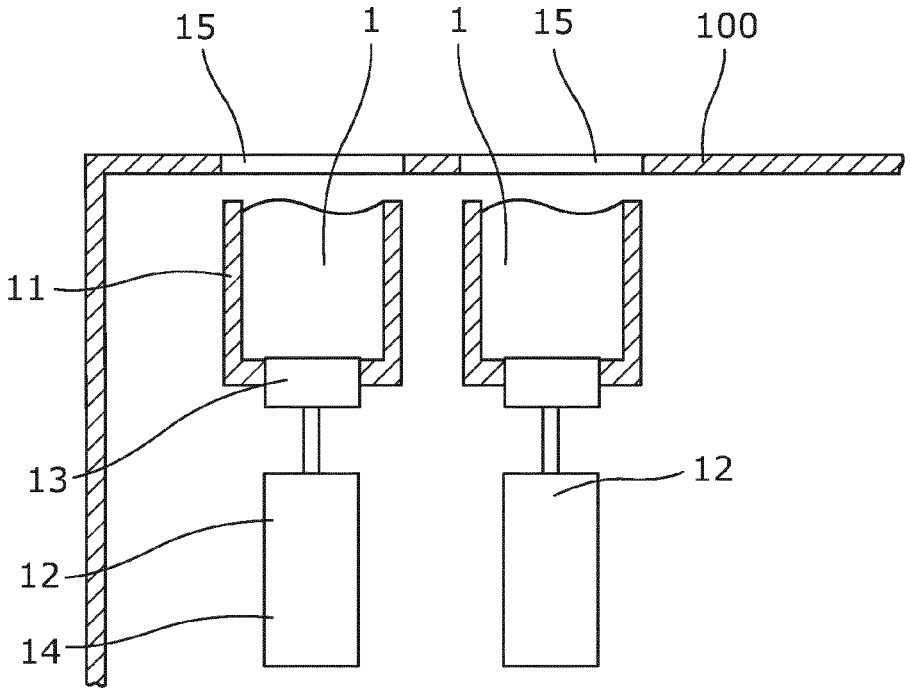
FIG. 5 shows a partly cross-sectional view of part of yet another embodiment of the downhole tool.

As shown in FIGS. 5 and 9, the tool 100 comprises two moving means 12 each moving a valve 1 or the punch 101 to penetrate the casing wall 2. The tool 100 comprises an electrical motor 26 for driving a pump 27 providing hydraulic power to the moving means 12, enabling the valve 1 to penetrate the casing wall 2. The moving means 12 may also be driven directly by the motor 26 without the use of hydraulics.

Figure 6:
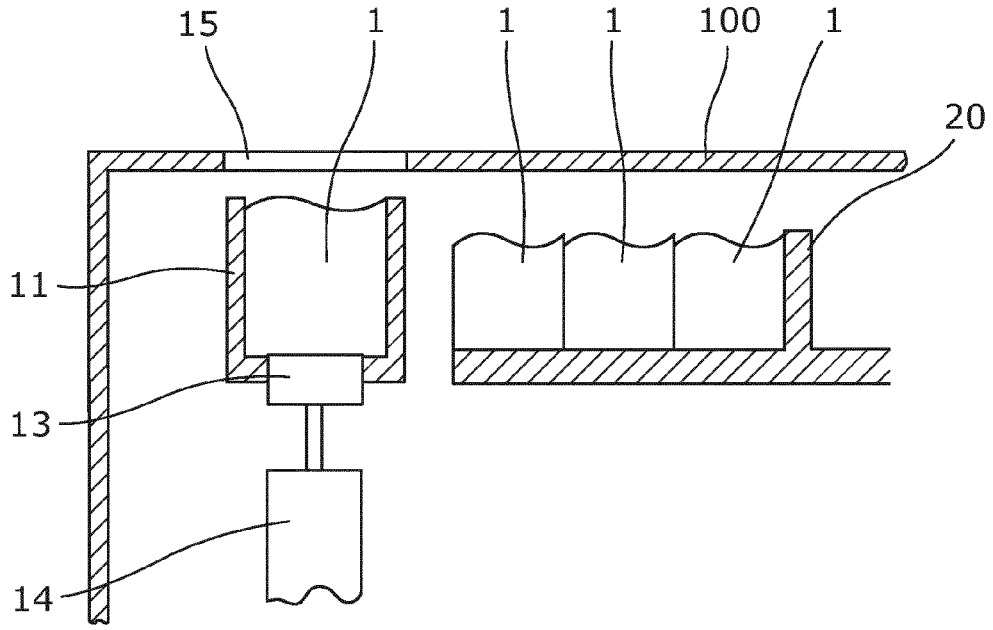
FIG. 6 shows a partly cross-sectional view of part of yet another embodiment of the tool.

In another embodiment, the tool 100 comprises a magazine 20 holding several valves or punches ready to be inserted into the holder 11, as shown in FIG. 6. When one valve or punch is inserted in a position in the casing 3, the tool 100 moves and the holder 11 is loaded with a second valve or second punch from the magazine 20, and when the tool reaches a new position, the second valve or second punch is ready to be inserted into the casing wall 2.

While moving the valve 1 to penetrate the casing wall 2, the moving means 12 may also screw the valve 1 through the casing 3.

In another embodiment, the moving means 12 rotates the valve 1 so that the valve 1 drills itself through the casing 3.

The holder 11 acts as a stop means for controlling the moving means 12 to ensure that the valve 1 or punch 101 penetrates the wall 2 of the casing 3 and the second end face is aligned with an inner face 7 of the wall 2 of the casing 3. The tool 100 may also have a separate stop means if the holder 11 is not designed to abut the inner face of the casing 3.

The downhole punch or downhole valve may be replaced by arranging a second downhole punch or downhole valve at the position of the former punch or valve which it is to replace, and pushing the second punch or valve into the hole and replacing the former unit. The second punch or valve may have a slightly larger outer diameter than the former punch or valve in order that the second punch or valve can be properly fastened.

In order to fasten the downhole punch or downhole valve, it is designed having no clearance and will consequently fasten itself by means of friction. The hole punched in the casing does not have to have an inner diameter as large as the outer diameter of the punch or valve as the cutting edge merely needs to make a hole in the casing in order to gain contact with fluid in the annulus surrounding the casing.

The downhole tool 100 may be connected with a driving unit 22, such as a downhole tractor, for moving the tool forward in the casing 3. The downhole tool 100 and the driving unit 22 together form a downhole system. The driving unit comprises four projectable and retractable wheel arms 31 each connected with a wheel 30.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By a casing is meant any kind of pipe, tubing, tubular, liner, string etc. used downhole in relation to oil or natural gas production.

In the event that the tool is not submergible all the way into the casing 3, a downhole tractor can be used to push the tool all the way into position in the well. A downhole tractor is any kind of driving tool capable of pushing or pulling tools in a well downhole, such as a Well Tractor®.

Although the invention has been described above in connection with preferred embodiments of the invention, it will be evident for a person skilled in the art that several modifications are conceivable without departing from the invention as defined by the following claims.

The invention claimed is:

1. A downhole valve assembly for insertion into a wall of a casing, comprising:

a housing having a first end and a second end as well as an inner face and an outer face, wherein the first end of the housing comprises at least one cutting edge at least forming a leading tip or a leading edge for punching an opening in the casing, wherein the cutting edge is arranged as an extension of the outer face, a downhole valve arranged in the housing, and wherein the housing, including the downhole valve, is structured and dimensioned so that neither the downhole valve nor the housing extends into any inner face of the wall of the casing when disposed in the opening.

2. The downhole valve assembly according to claim 1, wherein the cutting edge extends from the inner face of the housing to the outer face of the housing.

3. The downhole valve assembly according to claim 1, wherein the housing has a circumference and the cutting edge extends partly or fully around the circumference.

4. The downhole valve assembly according to claim 1, wherein the downhole valve is an inflow control valve, a gas lift valve, a throttle or a pressure control valve.

5. A downhole tool for inserting the downhole valve assembly according to claim 1.

6. The downhole tool according to claim 5, further comprising a mover to move the downhole valve transversely within the casing, wherein the mover comprises a piston structured to punch the downhole valve through the casing.

7. The downhole tool according to claim 5, further comprising a mover to move the downhole valve transversely within the casing, wherein the mover is configured to screw the downhole valve through the casing.

8. The downhole tool according to claim 5, further comprising a mover to move the downhole valve transversely within the casing, wherein the mover is configured to rotate the downhole valve so that the downhole valve drills itself through the casing.

9. The downhole tool according to claim 5, further comprising a magazine comprising several valves to be inserted into the wall of the casing.

10. The downhole tool according to claim 5, further comprising a stop for controlling a valve mover so that the downhole valve penetrates the wall of the casing and a second end face of the second end of the housing is aligned with the inner face of the wall of the casing.

11. A downhole system comprising the downhole tool according to claim 5, and including the casing, and a driving unit to move the downhole tool forward in the casing, wherein neither the housing nor the downhole valve extends into any inner face of the wall of the casing when disposed in the opening.

12. The downhole valve assembly according to claim 1, wherein the second end of the housing dimensioned to be flush with any inner face of the wall of the casing.

13. A downhole punch for insertion into a wall of a casing, comprising:

a body having a first end and a second end and a through-bore forming an inner face of the body and an outer face of the body, wherein the first end comprises at least one cutting edge at least forming a leading tip or a leading edge for punching an opening in the casing, and wherein a component in the form of a sensor, an emitter, a receiver, or a communication device is arranged in the through-bore, wherein the cutting edge is arranged as an extension of the outer face, wherein the body, including the component, is dimensioned and structured so that neither the body nor the component extends into any inner face of the wall of the casing when disposed in the opening.

14. The downhole punch according to claim 13, wherein the component is the sensor, and the sensor is a temperature sensor, pressure sensor, resistivity sensor, electromagnetic sensor, acoustic sensor, capacitance sensor or density sensor.

15. The downhole punch according to claim 13, wherein the cutting edge extends from the inner face of the body to the outer face of the body.

16. The downhole punch according to claim 13, wherein the body in cross-section has a circumference and the cutting edge extends partly or fully around the circumference.

17. A method for insertion of a downhole valve assembly into a wall of a casing, the downhole valve assembly comprising:

a housing having a first end and a second end as well as an inner face and an outer face, wherein the first end of the housing comprises at least one cutting edge at least forming a leading tip or a leading edge for punching an opening in the casing, wherein the cutting edge is arranged as an extension of the outer face, a downhole valve arranged in the housing, and the method comprising:

arranging the downhole valve assembly at a predetermined position, and punching the downhole valve assembly into the opening so that neither the downhole valve nor the housing extends into any inner face of the wall of the casing when disposed in the opening.

18. A method according to claim 17, further comprising arranging a second downhole valve assembly at a predetermined position, and pushing the second downhole valve assembly into the opening and replacing the downhole valve assembly.

19. A method according to claim 18, wherein the second downhole valve assembly has a larger outer diameter than the downhole valve assembly which it replaces.

20. A method according to claim 17, wherein the second end of the housing is dimensioned to be flush with any inner face of the wall of the casing.

* * * * *